US009980046B2

(12) United States Patent
Parker et al.

(10) Patent No.: US 9,980,046 B2
(45) Date of Patent: May 22, 2018

(54) MICROPHONE DISTORTION REDUCTION

(71) Applicant: INVENSENSE, INC., San Jose, CA (US)

(72) Inventors: Jeremy Parker, Chelmsford, MA (US); Sushil Bharatan, Burlington, MA (US); Erhan Polatkan Ata, Santa Clara, CA (US)

(73) Assignee: INVENSENSE, INC., San Jose, CA (US)

( * ) Notice: Subject to any disclaimer, the term of this patent is extended or adjusted under 35 U.S.C. 154(b) by 0 days. days.

(21) Appl. No.: 15/280,607

(22) Filed: Sep. 29, 2016

(65) Prior Publication Data

US 2018/0091900 A1 Mar. 29, 2018

(51) Int. Cl.

| | |
|---|---|
| ***H04R 3/06*** | (2006.01) |
| ***H04R 19/04*** | (2006.01) |
| *H04R 29/00* | (2006.01) |

(52) U.S. Cl.

CPC ..... *H04R 3/06* (2013.01); *H04R 19/04* (2013.01); *H04R 29/004* (2013.01); *H04R 2201/003* (2013.01)

(58) Field of Classification Search

CPC ..... H04R 3/06; H04R 19/04; H04R 29/004; H04R 2201/003

See application file for complete search history.

(56) References Cited

U.S. PATENT DOCUMENTS

| | | | | |
|---|---|---|---|---|
| 6,745,155 | B1 * | 6/2004 | Andringa | G01R 23/175 381/58 |
| 8,023,668 | B2 * | 9/2011 | Pfaffinger | H04R 29/001 381/164 |
| 8,078,433 | B2 * | 12/2011 | Klippel | G06F 17/5036 327/560 |
| 2005/0047606 | A1 | 3/2005 | Lee et al. | |
| 2010/0166216 | A1 * | 7/2010 | Chambers | H04R 3/04 381/94.9 |
| 2015/0125003 | A1 * | 5/2015 | Wiesbauer | B81B 3/0021 381/111 |

(Continued)

FOREIGN PATENT DOCUMENTS

WO 2014174283 A1 10/2014

*Primary Examiner* — Brenda C Bernardi

(74) *Attorney, Agent, or Firm* — Amin, Turocy & Watson, LLP

(57) ABSTRACT

Microphone distortion reduction is presented herein. A system can comprise: a processor; and a memory that stores executable instructions that, when executed by the processor, facilitate performance of operations, comprising: obtaining a pressure-in to voltage-out transfer function representing a distortion of an output of a microphone corresponding to a stimulus of a defined sound pressure level that has been applied to the microphone; inverting an equation representing the pressure-in to voltage-out transfer function to obtain an inverse transfer function; and applying the inverse transfer function to the output to obtain a linearized output representing the stimulus. In one example, the obtaining of the pressure-in to voltage-out transfer function comprises: creating an ideal sine wave stimulus comprising the amplitude and fundamental frequency of the time domain waveform; and generating the equation based on a defined relationship between the ideal sine wave stimulus and the time domain waveform.

20 Claims, 11 Drawing Sheets

(56) References Cited

U.S. PATENT DOCUMENTS

| | | | | |
|---|---|---|---|---|
| 2015/0195647 | A1 | 7/2015 | Srinivasan et al. | |
| 2015/0249889 | A1 | 9/2015 | Iyer et al. | |
| 2015/0296299 | A1 | 10/2015 | Klippel | |
| 2016/0157017 | A1* | 6/2016 | Lesso | G01D 5/24 381/71.7 |
| 2016/0344358 | A1* | 11/2016 | Oliaei | H04R 1/08 |

* cited by examiner

MICROPHONE DISTORTION REDUCTION

TECHNICAL FIELD

The subject disclosure generally relates to embodiments for microphone distortion reduction.

BACKGROUND

Microphones are generally designed to convert acoustic signals to electrical signals with as little distortion as possible. However, a microphone's mechanism of transduction is an inherent source of distortion. In this regard, a capacitive based microphone is associated with a non-linear pressure-in to voltage-out transfer function, resulting in undesirable harmonic distortion. Conventional technologies for reducing such distortion include increasing a capacitive sensing gap of a microphone, reducing a sensitivity of the microphone, and creating a dual-backplate capacitive sensing structure. However, as such technologies correspond to modification of the microphone structure at increased design cost and complexity, and only partially reduce, e.g., even-ordered, harmonic distortion. In this regard, conventional microphone technologies have had some drawbacks, some of which may be noted with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
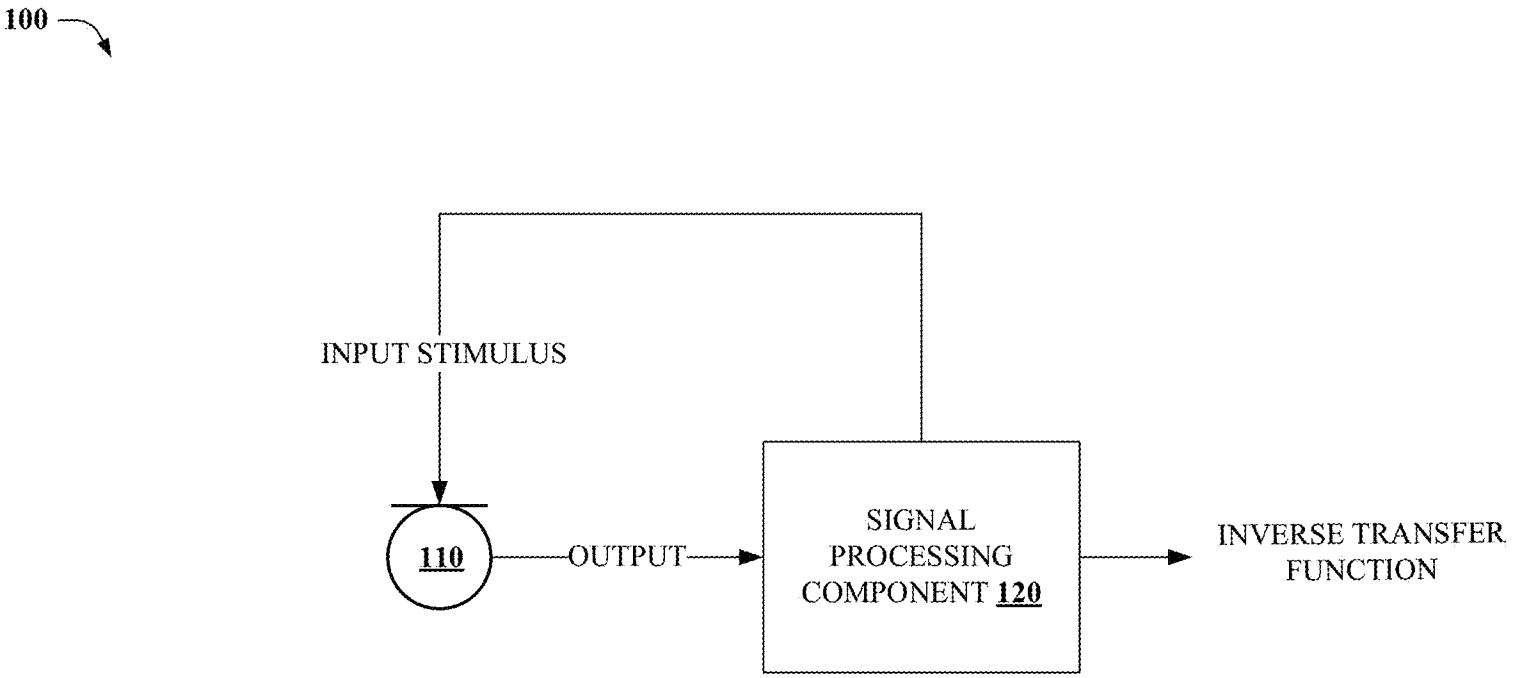
FIG. 1 illustrates a block diagram of a microphone system, in accordance with various example embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

As described above, conventional microphone technologies have had some drawbacks with respect to reducing distortion. Various embodiments disclosed herein can reduce microphone distortion by applying a linearization filter, or inverse transfer function, to an output of a microphone.

For example, a system can comprise: a processor; and a memory that stores executable instructions that, when executed by the processor, facilitate performance of operations, comprising: obtaining a pressure-in to voltage-out transfer function representing a distortion of an output of a microphone corresponding to an input stimulus of a defined sound pressure level (SPL) that has been applied to the microphone, e.g., a micro-electro-mechanical system (MEMS) microphone, an electret microphone comprising a charged diaphragm and/or a backplate, a condenser microphone, a measurement microphone, a calibrated transducer, an ultrasonic sensor, etc.; and inverting an equation/function, e.g., a polynomial function, a logarithmic function, a hyperbolic function, etc. representing the pressure-in to voltage-out transfer function representing the distortion to obtain an inverse transfer function for facilitating an application, by the microphone, e.g., via a digital signal processing domain, via an analog circuit processing domain, etc. of the inverse transfer function to the output to obtain a linearized output representing the input stimulus.

In one embodiment, the obtaining the pressure-in to voltage-out transfer function representing the distortion comprises measuring an output voltage of the microphone corresponding to the input stimulus. In another embodiment, the obtaining the pressure-in to voltage-out transfer function representing the distortion comprises deriving the output voltage during a simulation of a defined model of the microphone comprising production based parameters of the microphone—the input stimulus being applied to the defined model during the simulation.

In yet another embodiment, the obtaining the pressure-in to voltage-out transfer function representing the distortion comprises importing, obtaining, receiving, etc. output data of a time domain waveform representing an output voltage of the microphone with respect to the input stimulus; and based on the output data, obtaining properties of the time domain waveform comprising an amplitude of the time domain waveform and a fundamental frequency of the time domain waveform.

Further, the operations can comprise: creating an ideal sine wave stimulus comprising the amplitude of the time domain waveform and the fundamental frequency of the time domain waveform; and generating the equation/function representing the pressure-in to voltage-out transfer function representing the distortion based on a defined relationship between the ideal sine wave stimulus and the time domain waveform, e.g., based on a voltage difference between the ideal sine wave stimulus and the time domain waveform with respect to a defined alignment, e.g., within 1%, of respective phases of the ideal sine wave stimulus and the time domain waveform. In another example, the voltage difference between the ideal sine wave stimulus and the time domain waveform can be determined in response to minimizing a root-mean-square (RMS) error between the ideal sine wave stimulus and the time domain waveform by adjusting a phase angle of the ideal sine wave stimulus.

In one embodiment, the microphone comprises: a diaphragm, e.g., a flexible diaphragm comprising a semiconductor material, conductor, etc. that converts the SPL, e.g., an acoustic pressure, sound pressure, sound wave, etc. into an electrical signal; a single backplate capacitively coupled to a side of the flexible diaphragm; and an electronic amplifier that buffers the electrical signal to generate the output. In this regard, the backplate can be biased by a positive, direct current (DC) voltage that can facilitate measurement of sound pressure induced deflections of the flexible diaphragm as a time varying voltage and/or current—the sound pressure induced deflections generating a change in capacitance between the flexible diaphragm and the backplate as the flexible diaphragm moves towards/away from the backplate.

In another embodiment, the microphone comprises dual backplates capacitively coupled to respective sides of the flexible diaphragm. In this regard, respective DC voltages biasing the dual backplates facilitate measuring sound pressure induced deflections of the flexible diaphragm as a time varying voltage and/or current—the sound pressure induced deflections generating a change in capacitance between the flexible diaphragm and the dual backplates as the flexible diaphragm moves towards/away from the dual backplates.

In yet another embodiment, the distortion comprises odd-order harmonic distortion and even-order harmonic distortion. In yet another embodiment, the distortion is not frequency dependent or time dependent.

In an embodiment, a MEMS microphone can comprise: a processor, e.g., a digital signal processor (DSP); and a memory that stores executable instructions that, when executed by the processor, facilitate performance of operations, comprising: generating, using a function, e.g., a polynomial equation, a logarithmic equation, a hyperbolic equation, etc. of a transfer function representing a distortion of an output voltage of the MEMS microphone with respect to an input stimulus of a defined sound pressure level (SPL) that has been applied to the microphone; generating, using the function, a linearization filter; and applying, e.g., via a digital processing domain, via analog circuitry, etc. the linearization filter to the output voltage of the MEMS microphone to obtain a linearized output representing the input stimulus.

In one embodiment, the function has been derived by: obtaining output data of a time domain waveform representing the output voltage; and based on the output data, deriving properties of the time domain waveform comprising an amplitude of the time domain waveform and a fundamental frequency of the time domain waveform.

In another embodiment, the function has further been derived by: creating a model sine wave stimulus comprising the amplitude of the time domain waveform and the fundamental frequency of the time domain waveform; and selecting the function based on a defined relationship between the output voltage of the MEMS microphone and the model sine wave stimulus, e.g., with respect to an alignment of respective phases of the output voltage and the model sine wave stimulus.

In yet another embodiment, the MEMS microphone comprises: a diaphragm that converts the SPL into an electrical signal; a single backplate capacitively coupled to a side of the diaphragm; and an electronic amplifier that buffers the electrical signal to generate the output. In another embodiment, the MEMS microphone comprises: dual backplates capacitively coupled to respective sides of the diaphragm. In this regard, respective DC voltages biasing the dual backplates facilitate measuring sound pressure induced deflections of the flexible diaphragm as a time varying voltage and/or current—the sound pressure induced deflections generating a change in capacitance between the flexible diaphragm and the dual backplates as the flexible diaphragm moves towards/away from the dual backplates.

In an embodiment, a method can comprise: selecting, by a system comprising a processor, an equation, e.g., polynomial equation, logarithmic equation, hyperbolic equation, etc. of a transfer function representing a distortion of a voltage output of a microphone with respect to a stimulus, e.g., SPL, sound wave, etc. that has been applied to the microphone, e.g., via a simulation of a model of the microphone, via production testing of the microphone, etc.; generating, by the system using the equation, an inverse transfer function; and facilitating, by the system, an application, by the microphone, e.g., using digital signal processing, using analog circuitry, e.g., transistor(s), etc., of the inverse transfer function to the voltage output to obtain a linearized output representing the stimulus.

In one embodiment, the selecting of the equation comprises: obtaining, by the system, data representing the voltage output of the microphone; generating, by the system, a representative stimulus having an amplitude of the voltage output and a fundamental frequency of the voltage output; and selecting, by the system, the equation according to a defined relationship between the voltage output and the representative stimulus, e.g., with respective phases of the voltage output and the representative stimulus being aligned, substantially aligned, e.g., within 1%, etc.

In another embodiment, the selecting comprises: measuring, by the system, the voltage output. In yet another embodiment, the selecting comprises: deriving, during a simulation of a defined model of the microphone based on defined production parameters corresponding to the microphone, the voltage output.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Aspects of MEMS microphones, apparatus, devices, processes, and process blocks explained herein can be embodied within hardware, such as an application specific integrated circuit (ASIC) or the like. Moreover, the order in which some or all of the process blocks appear in each process should not be deemed limiting. Rather, it should be understood by a person of ordinary skill in the art having the benefit of the instant disclosure that some of the process blocks can be executed in a variety of orders not illustrated.

Furthermore, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art having the benefit of the instant disclosure.

Conventional microphone technologies have had some drawbacks with respect to reducing output distortion. On the other hand, various embodiments disclosed herein can reduce microphone distortion, e.g., odd-order distortion and even-order distortion, by applying a linearization filter, or inverse transfer function, to an output of a microphone. In this regard, and now referring to FIG. 1, a microphone system (100) comprising a signal processing component (120) for improving output distortion of the microphone is illustrated, in accordance with various example embodiments.

In this regard, microphone system 100 comprises acoustic sensor 110, e.g., a MEMS based transducer, an electret microphone, a condenser microphone, a measurement microphone, a calibrated transducer, an ultrasonic sensor, etc. that comprises a flexible diaphragm (not shown), e.g., comprising a semiconductor material, a conductor, etc. that converts an input stimulus of a defined SPL, acoustic pressure, sound pressure, sound wave, etc. that has been applied to acoustic sensor 110 into an electrical signal, and a backplate (not shown), dual backplates (not shown), etc., e.g., comprising respective conductor(s), semiconductor(s), etc. that are capacitively coupled to respective side(s) of the flexible diaphragm.

In one embodiment, the backplate, dual backplates, etc. can be biased by respective DC voltage source(s) (not shown), e.g., a charge pump, a switch capacitor voltage source, etc. In this regard, the respective DC voltage source (s) facilitate measurement of acoustic pressure induced deflections of the flexible diaphragm as a time varying voltage and/or current—such deflections generating a change in capacitance between flexible diaphragm and the backplate, dual backplates, etc. In turn, an electronic amplifier (not shown) can buffer the time varying voltage and/or current as a buffered output, e.g., output, representing the input stimulus of the defined SPL that has been applied to acoustic sensor 110.

In embodiment(s), acoustic sensor 110 comprises a defined model of a microphone, e.g., the MEMS based transducer, the electret microphone, the condenser microphone, the measurement microphone, the calibrated transducer, the ultrasonic sensor, etc. comprising production based parameters, and the input stimulus can be applied by signal processing component 120 via simulation of the defined model of the microphone. In other embodiment(s), acoustic sensor 110 comprises a manufactured device, e.g., comprising nominal production based characteristics, and the input stimulus of the defined SPL can be applied to the microphone by signal processing component 120 utilizing a transducer, speaker, etc. (not shown).

Figure 2:
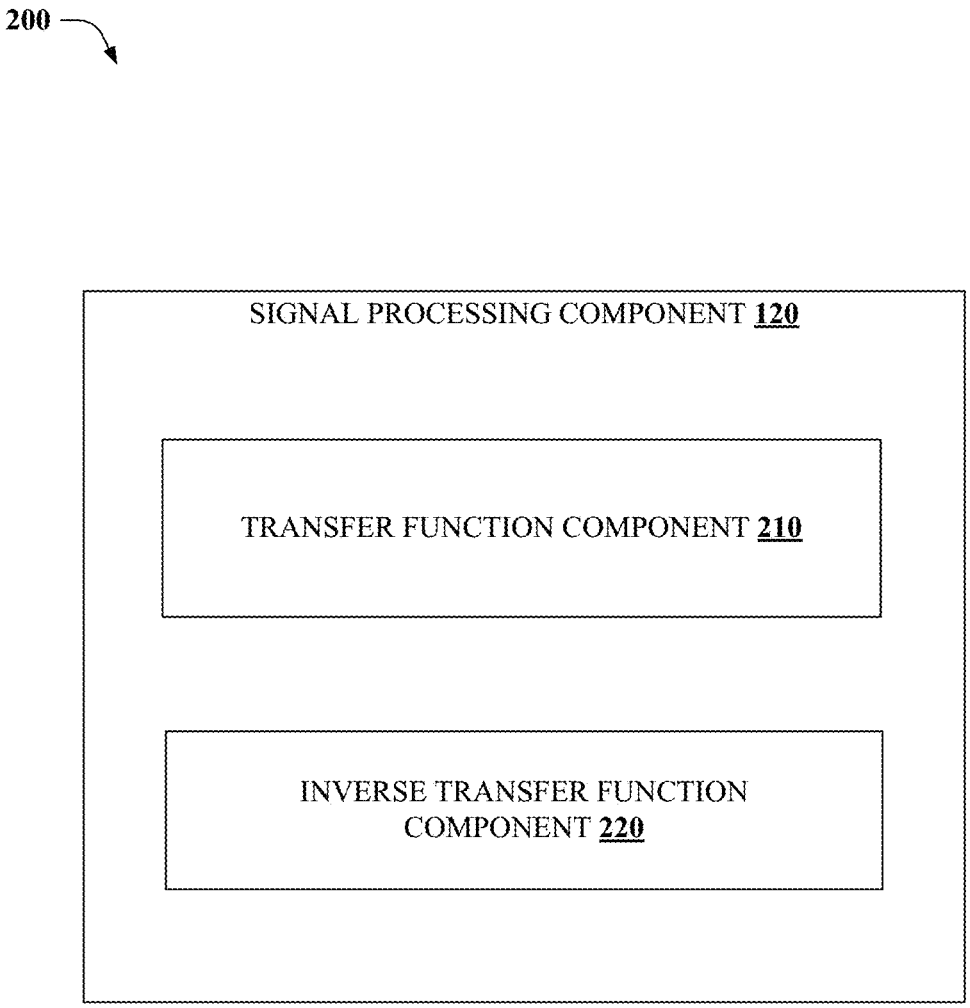
FIG. 2 illustrates a block diagram of a signal processing component, in accordance with various example embodiments.
Figure 3:
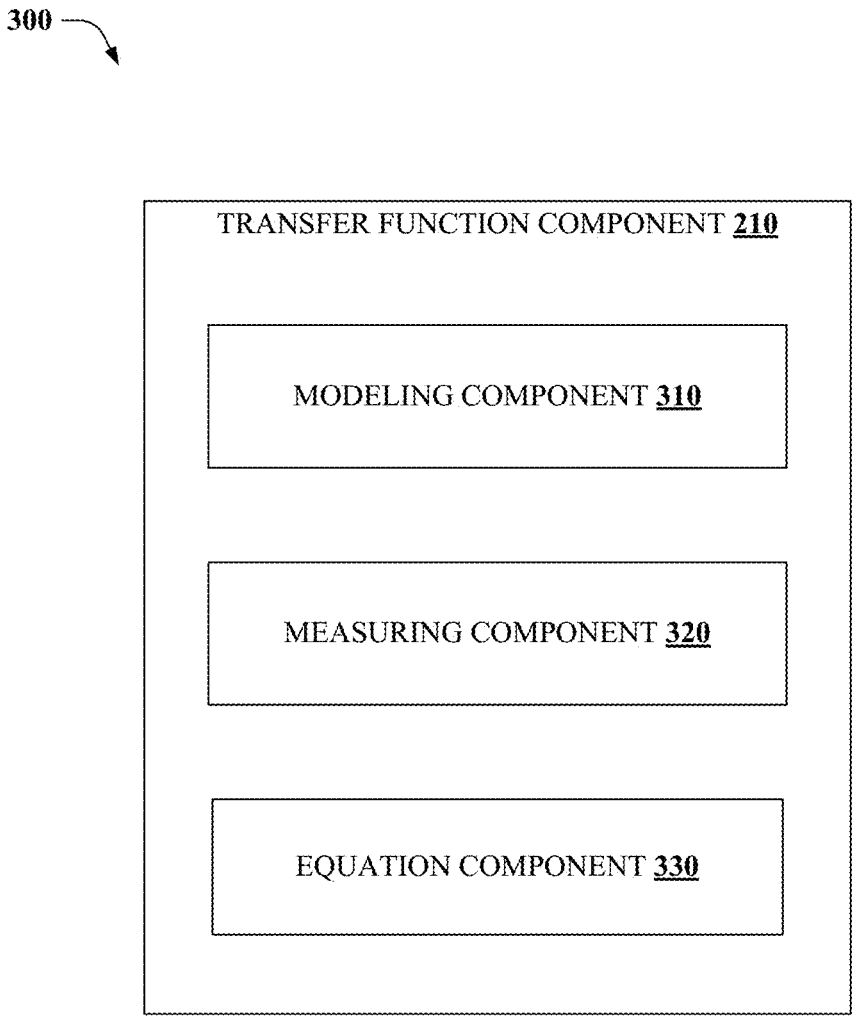
FIG. 3 illustrates a block diagram of a transfer function component, in accordance with various example embodiments.

Now referring to FIGS. 2 and 3, signal processing component 120 can comprise transfer function component 210 and inverse transfer function component 220. Transfer function component 210 can be configured to obtain a pressure-in to voltage-out transfer function representing a distortion of the output corresponding to the input stimulus of the defined SPL that has been applied to acoustic sensor 110. For example, in an embodiment illustrated by FIG. 3, transfer function component 210 can comprise modeling component 310, which can be configured to derive, e.g., during a simulation of a defined model of the microphone, e.g., comprising production based parameters of the microphone, an output voltage of the defined model corresponding to the input stimulus being applied to the defined model during the simulation.

In another example embodiment, transfer function component 210 can comprise measuring component 320, which can be configured to apply, e.g., via a transducer, speaker, etc. (not shown) the input stimulus of the defined SPL, acoustic pressure, etc. to acoustic sensor 110, e.g., a microphone comprising a production sample corresponding to defined nominal performance characteristic(s), e.g., which have been measured, determined, etc. after production of the microphone. Further, measuring component 320 can be configured to measure an output voltage of the microphone corresponding to the input stimulus that has been applied, via the transducer, speaker, etc., to acoustic sensor 110.

Transfer function component 210 can further comprise equation component 330, which can be configured to obtain, import, receive, etc. output data of a time domain waveform representing the output voltage of the microphone, model of the microphone, etc. corresponding to the input stimulus that has been applied to acoustic sensor 110, e.g., via simulation, production measurement, etc. Further, equation component 330 can be configured to derive, obtain, determine, etc. properties of the time domain waveform based on the output data—such properties comprising an amplitude of the time domain waveform, a fundamental frequency of the time domain waveform, a phase of the time domain waveform, etc.

Furthermore, equation component 330 can be configured to create an ideal sine wave stimulus comprising the amplitude of the time domain waveform and the fundamental frequency of the time domain waveform; and generate an equation, e.g., a polynomial equation, a logarithmic equation, a hyperbolic equation, etc. representing the pressure-in to voltage-out transfer function representing the distortion based on a defined relationship between the ideal sine wave stimulus and the time domain waveform, e.g., based on a voltage difference between the ideal sine wave stimulus and the time domain waveform with respect to a defined alignment, e.g., within 1%, of respective phases of the ideal sine wave stimulus and the time domain waveform.

In another example, the voltage difference between the ideal sine wave stimulus and the time domain waveform can be determined in response to minimizing an RMS error between the ideal sine wave stimulus and the time domain waveform by adjusting a phase angle of the ideal sine wave stimulus.

In an example embodiment, equation component 330 can generate a polynomial equation based on a defined order, e.g., $3^{rd}$ order, $5^{th}$ order, $7^{th}$ order, $9^{th}$ order, etc. of polynomial.

Returning now to FIG. 2, inverse transfer function component 220 can be configured to invert the equation representing the pressure-in to voltage-out transfer function representing the distortion to obtain an inverse transfer function, linearization filter, etc. for facilitating an application, by the microphone, of the inverse transfer function, linearization filter, etc. to the output of the microphone to obtain a linearized output representing the input stimulus.

In an embodiment, the microphone can derive the inverse transfer function, linearization filter, etc., and/or apply the inverse transfer function, linearization filter, etc. to the output of the microphone using digital signal processing, e.g., via a processor, DSP, digital filter, etc.

In another embodiment, the microphone can derive the inverse transfer function, linearization filter, etc., and/or apply the inverse transfer function, linearization filter, etc. to the output of the microphone using analog circuitry, e.g., using non-linear circuit component(s), e.g., transistor(s), to approximate/apply the inverse transfer function.

Figure 4:
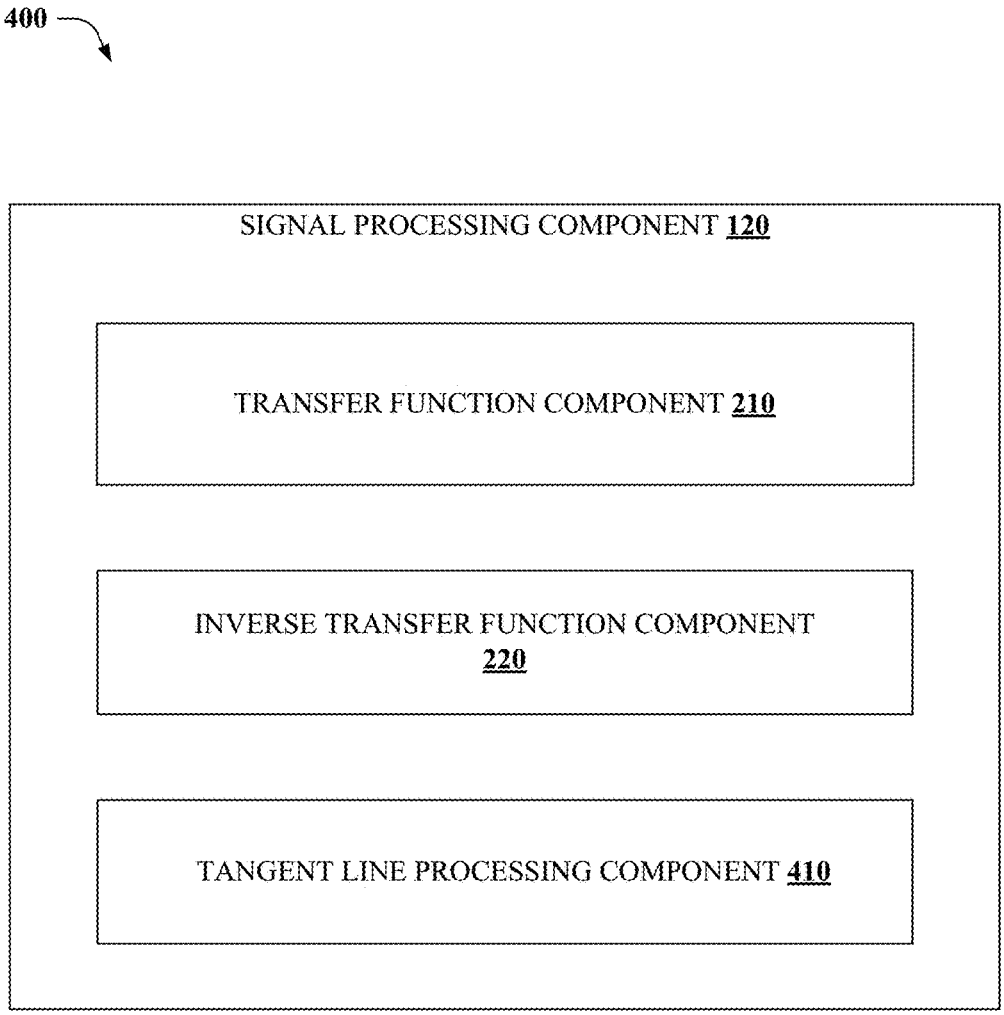
FIG. 4 illustrates a block diagram of an signal processing component comprising a tangent line processing component, in accordance with various example embodiments.

FIG. 4 illustrates signal processing component 120 comprising tangent line processing component 410, in accordance with various example embodiments. In this regard, tangent line processing component 410 can be configured to determine a derivative of a polynomial equation generated by equation component 330. Further, tangent line processing component 410 can be configured to determine tangent lines corresponding to a positive transition point of the polynomial equation and a negative transition point of the polynomial equation.

In this regard, in response to determining that an absolute value of the output voltage of the microphone, e.g., corresponding to the time domain waveform, is less than or equal to a defined positive voltage corresponding to the positive transition point, and the derivative of the polynomial equation is positive, signal processing component 120 can be configured to select, use, etc. data points corresponding to the polynomial equation for generation of the inverse transfer function, linearization filter, etc.

Further, in response to determining that a value of the output voltage of the microphone, e.g., corresponding to the time domain waveform, is greater than the defined positive voltage corresponding to the positive transition point, signal processing component 120 can be configured to select, use, etc. data points corresponding to a positive tangent line of the tangent lines corresponding to the positive transition point for generation of the inverse transfer function, linearization filter, etc., i.e., replacing data points of the polynomial equation corresponding to voltages greater than the defined positive voltage.

Furthermore, in response to determining that the value of the output voltage of the microphone is less than a defined negative voltage corresponding to the negative transition point, signal processing component 120 can be configured to use data points corresponding to a negative tangent line of the tangent lines corresponding to the negative transition point for generation of the inverse transfer function, linearization filter, etc., i.e., replacing data points of the polynomial equation corresponding to voltages less than the defined negative voltage.

Figure 5:
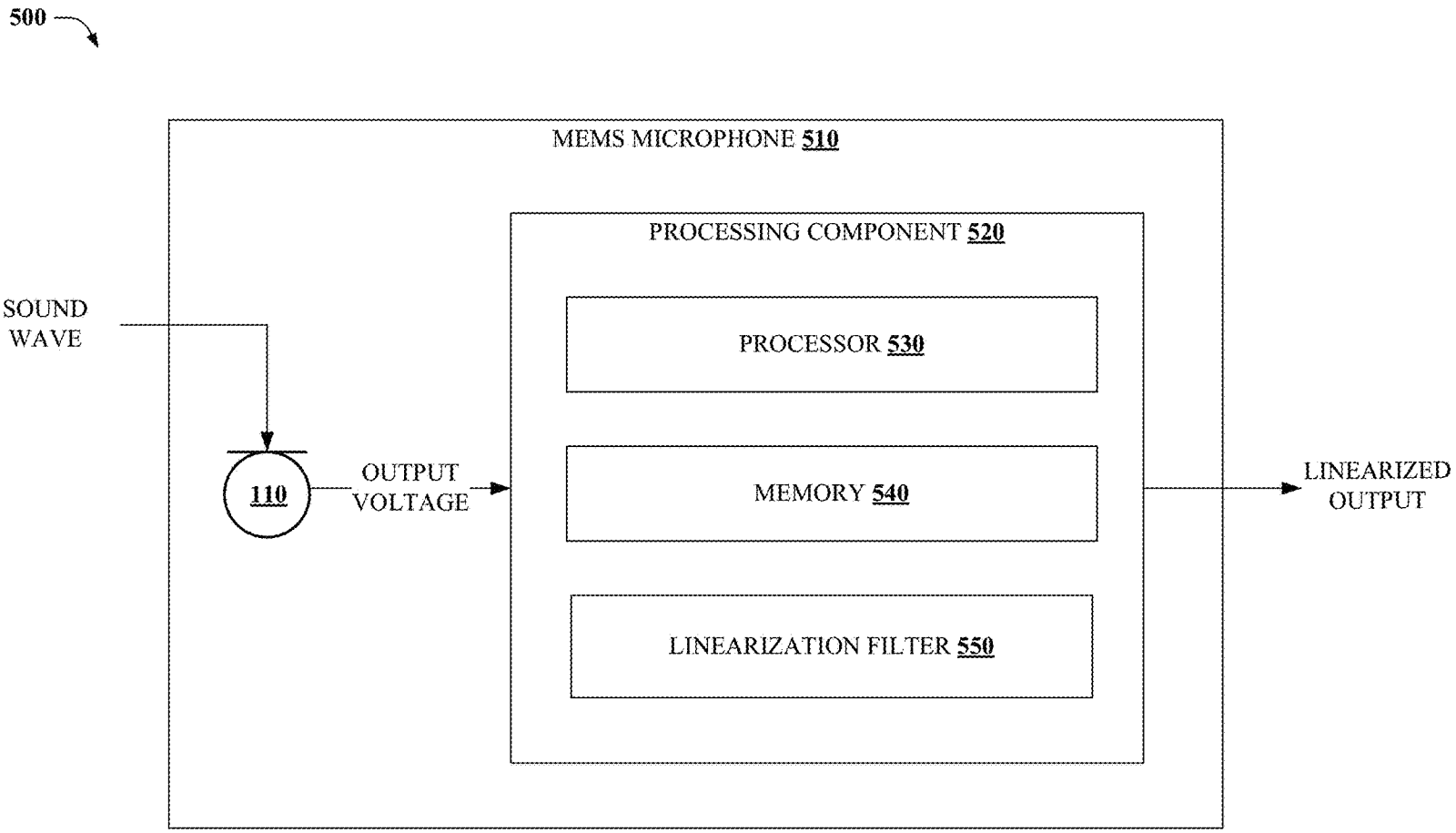
FIG. 5 illustrates a block diagram of a MEMS microphone, in accordance with various example embodiments.

FIG. 5 illustrates a block diagram (500) of a MEMS microphone (510), in accordance with various example embodiments. MEMS microphone 510 comprises MEMS acoustic sensor 110, which can convert, via an electronic amplifier (not shown), an input stimulus, e.g., a sound wave, of a defined SPL into an output voltage. Further, processing component 520, via processor 530 and memory 540, can receive the output voltage, and generate linearization filter 550 using an equation, e.g., a polynomial equation, a logarithmic equation, a hyperbolic equation, etc. of a transfer function representing a distortion of an output voltage of MEMS microphone 510 with respect to the input stimulus.

In this regard, in an example embodiment, processing component 520 can receive, e.g., from a system (e.g., 100), information representing the equation of the transfer function, and store the information in memory 530. Further, processing component 520 can generate, e.g., via digital signal processing, linearization filter 550 based on such stored information.

In another example embodiment, processing component 520 can receive, from the system, information representing an inverse transfer function corresponding to the polynomial, and store the information in memory 530. Further, processing component 520 can generate, e.g., via digital signal processing, linearization filter 550 based on such stored information representing the inverse transfer function. Furthermore, in another embodiment, processing component 520, via processor 530 and memory 540, can apply, via digital signal processing, linearization filter 550 to the output voltage, e.g., via a multiplication operation, to obtain a linearized output representing the input stimulus.

Figure 6:
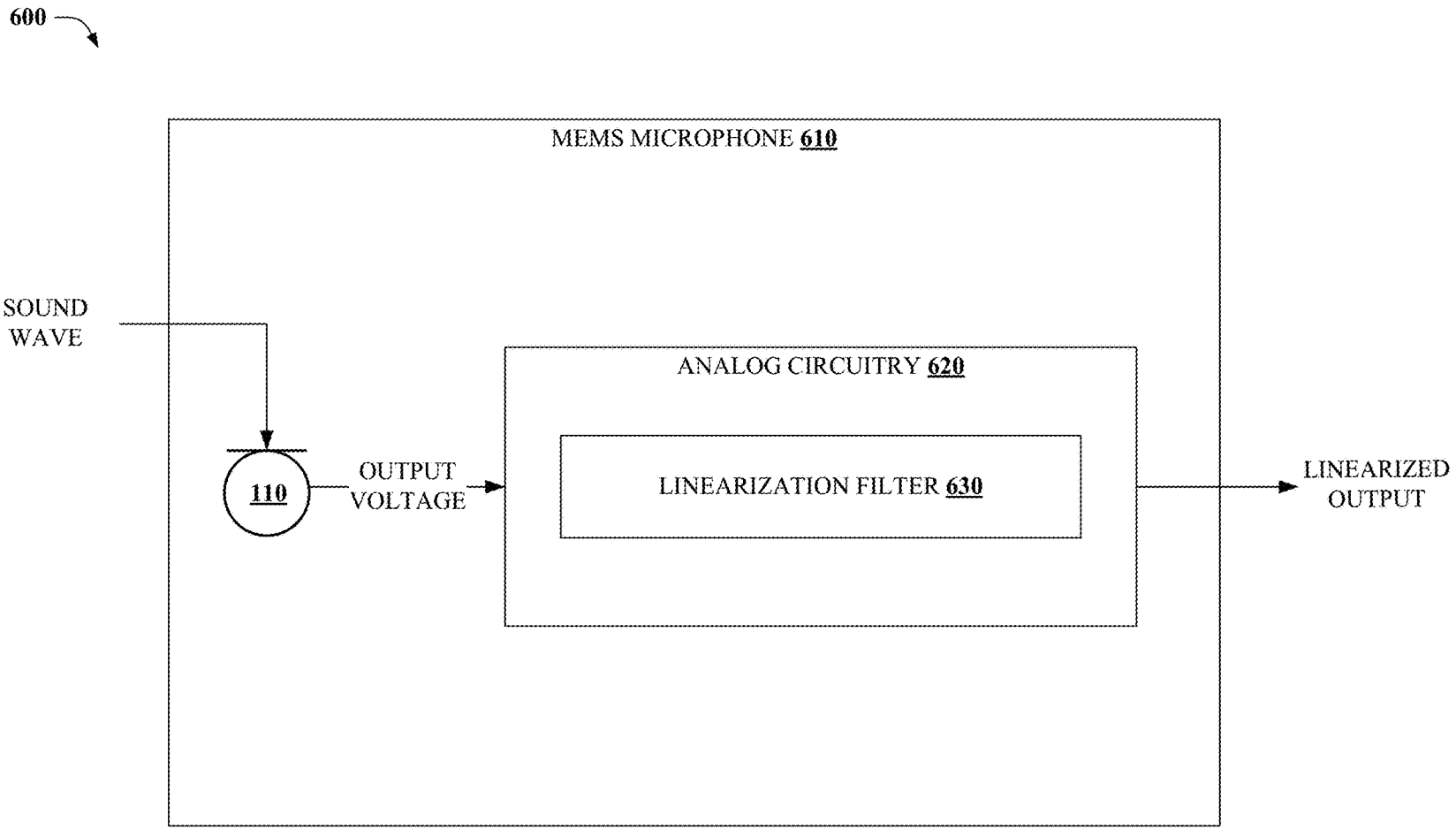
FIG. 6 illustrates a block diagram of another MEMS microphone, in accordance with various example embodiments.

FIG. 6 illustrates a block diagram (600) of another MEMS microphone (610), in accordance with various example embodiments. MEMS microphone 610 comprises analog circuitry 620, which can comprise non-linear circuit component(s), e.g., transistor(s), etc. (not shown). In this regard, analog circuitry 620 can be utilized to approximate the inverse transfer function, e.g., using linearization filter 630, e.g., comprised of the non-linear circuit component(s) (not shown).

FIGS. 7-10 illustrate methodologies in accordance with the disclosed subject matter. For simplicity of explanation, the methodologies are depicted and described as a series of acts. It is to be understood and appreciated that various embodiments disclosed herein are not limited by the acts illustrated and/or by the order of acts. For example, acts can occur in various orders and/or concurrently, and with other acts not presented or described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that methodologies disclosed hereinafter and throughout this specification are capable of being stored on an article of manufacture to facilitate transporting and transferring such methodologies to computers, processors, processing components, etc. The term article of manufacture, as used herein, is intended to encompass a computer program accessible from any computer-readable device, carrier, or media.

Figure 7:
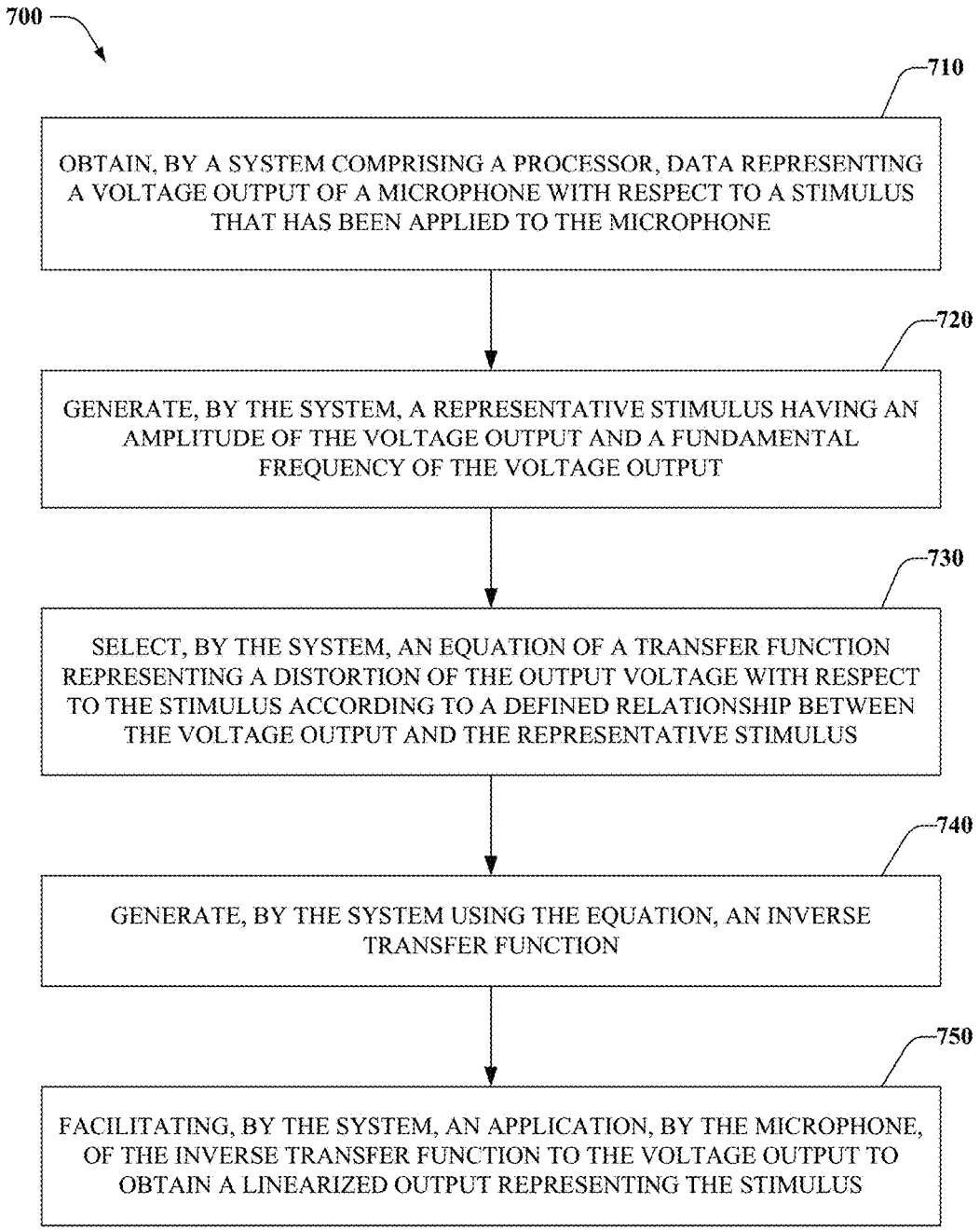
FIG. 7 illustrates a method corresponding to a microphone system, in accordance with various example embodiments.

Referring now to FIG. 7, a methodology associated with a microphone system (e.g. 100) is illustrated, in accordance with various non-limiting aspects of the disclosed subject matter. At 710, the microphone system can obtain data representing a voltage output of a microphone (e.g. 510) with respect to a stimulus, e.g., sine wave, sound wave, etc. of a defined SPL that has been applied to the microphone.

At 720, the microphone system can generate a representative stimulus, e.g., sine wave, having an amplitude of the voltage output and a fundamental frequency of the voltage output. At 730, the microphone system can select an equation, e.g., polynomial equation, logarithmic equation, hyperbolic equation, etc. of a transfer function representing a distortion of the output voltage with respect to the stimulus according to a defined relationship between the voltage output and the representative stimulus. In an embodiment, the defined relationship represents a voltage difference between the representative stimulus and the voltage output with respect to a defined alignment of respective phases of the representative stimulus and the voltage output. For example, in an embodiment, the microphone system can determine the voltage difference between the representative stimulus and the voltage output in response to minimizing an RMS error between the representative stimulus and the voltage output by adjusting a phase angle of the representative stimulus.

At 740, the microphone system can generate, using the equation, an inverse transfer function, linearization filter, etc. At 750, the microphone system can facilitate an application, by the microphone, of the inverse transfer function, linearization filter, etc. to the voltage output to obtain a linearized output representing the stimulus. For example, the system can send information representing the inverse transfer function, linearization filter, etc. to the microphone, and the microphone can store the information in memory 540 for use by processing component 520 to produce a linearized output. In another example, the microphone can comprise analog circuitry, e.g., non-linear circuit components, etc. for approximating the inverse transfer function, linearization filter, etc.

Figure 8:
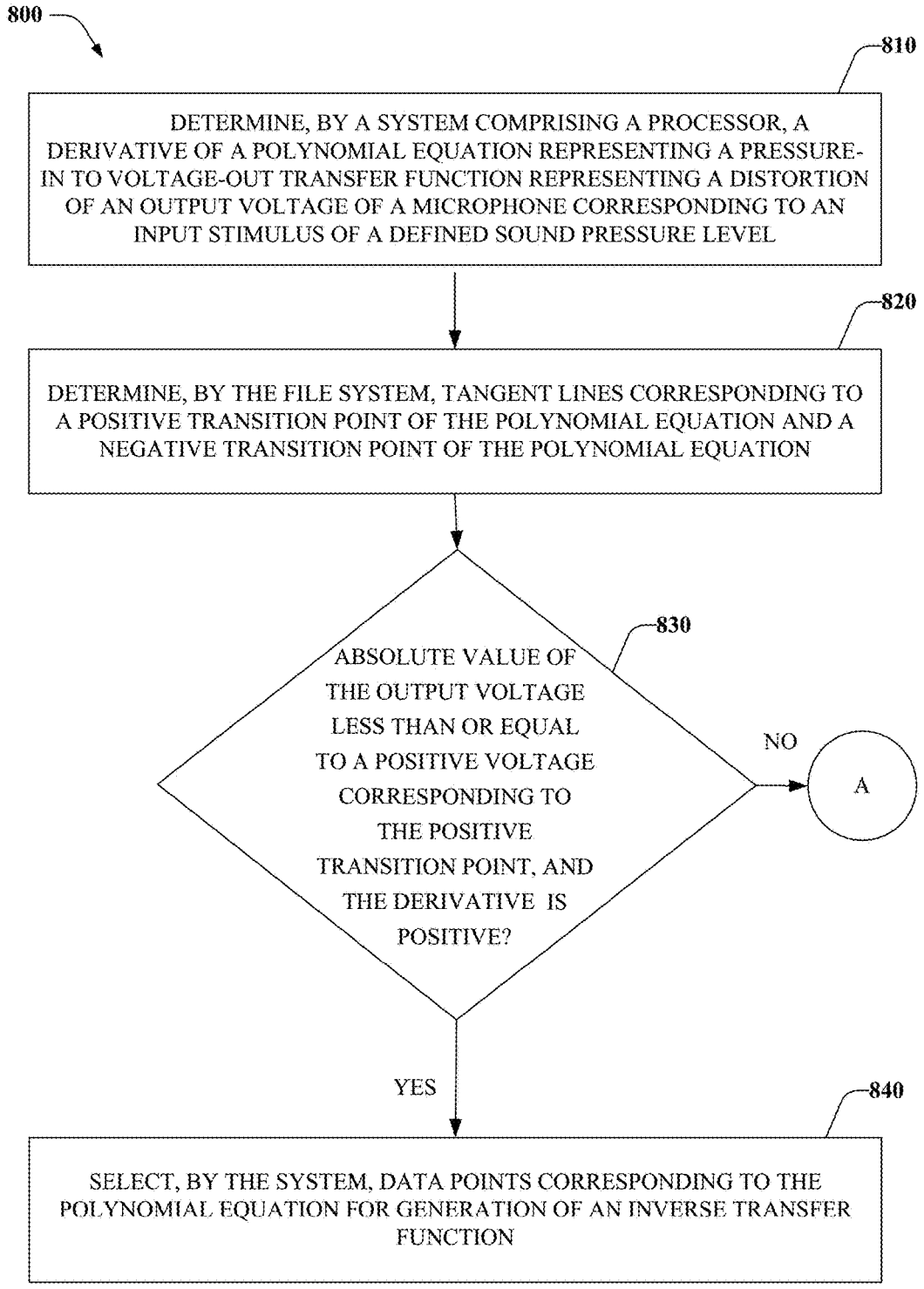
FIGS. 8-10 illustrate flowcharts of methods associated with a performing tangent line processing, in accordance with various example embodiments.
Figure 9:
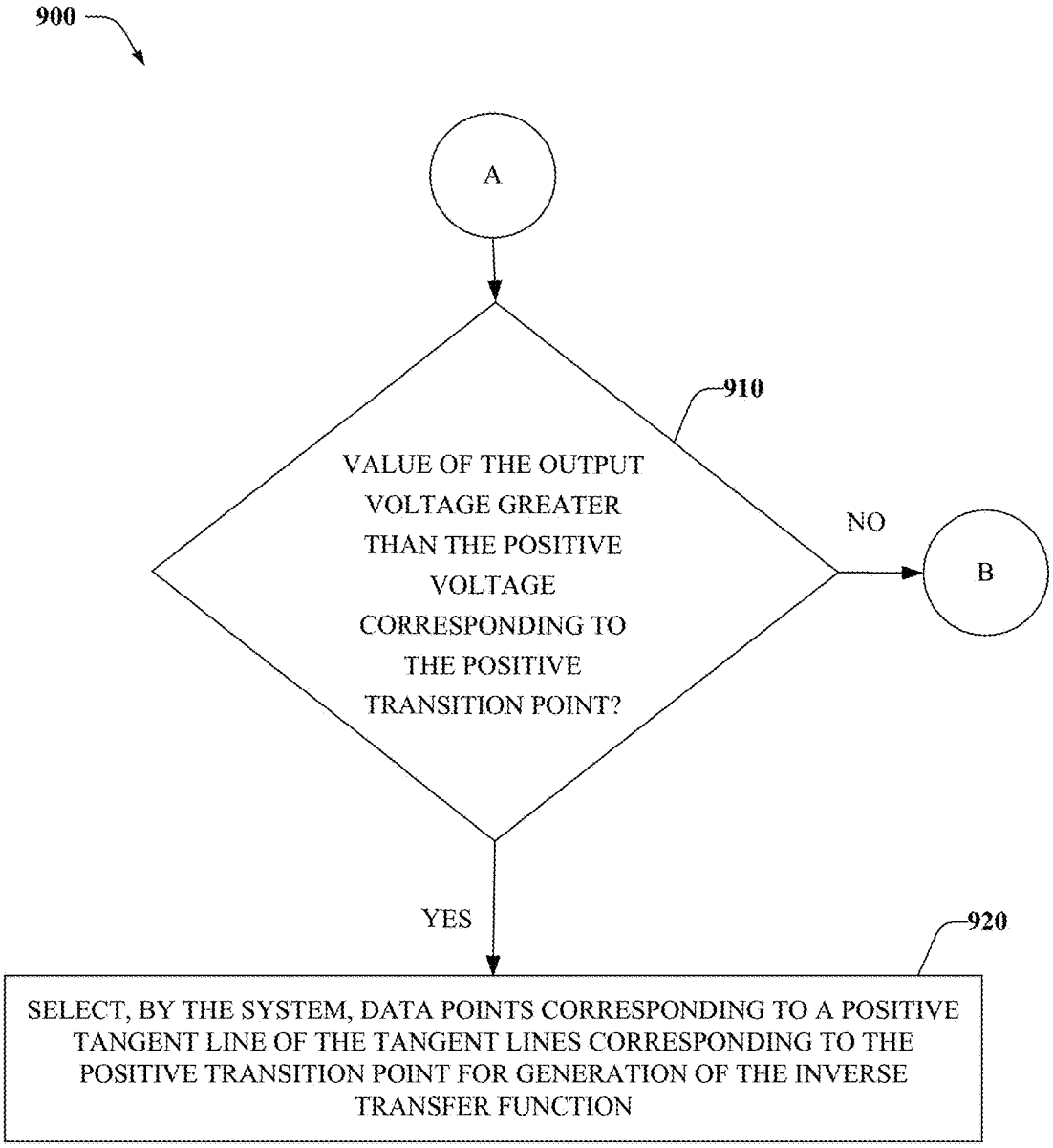
Figure 10:
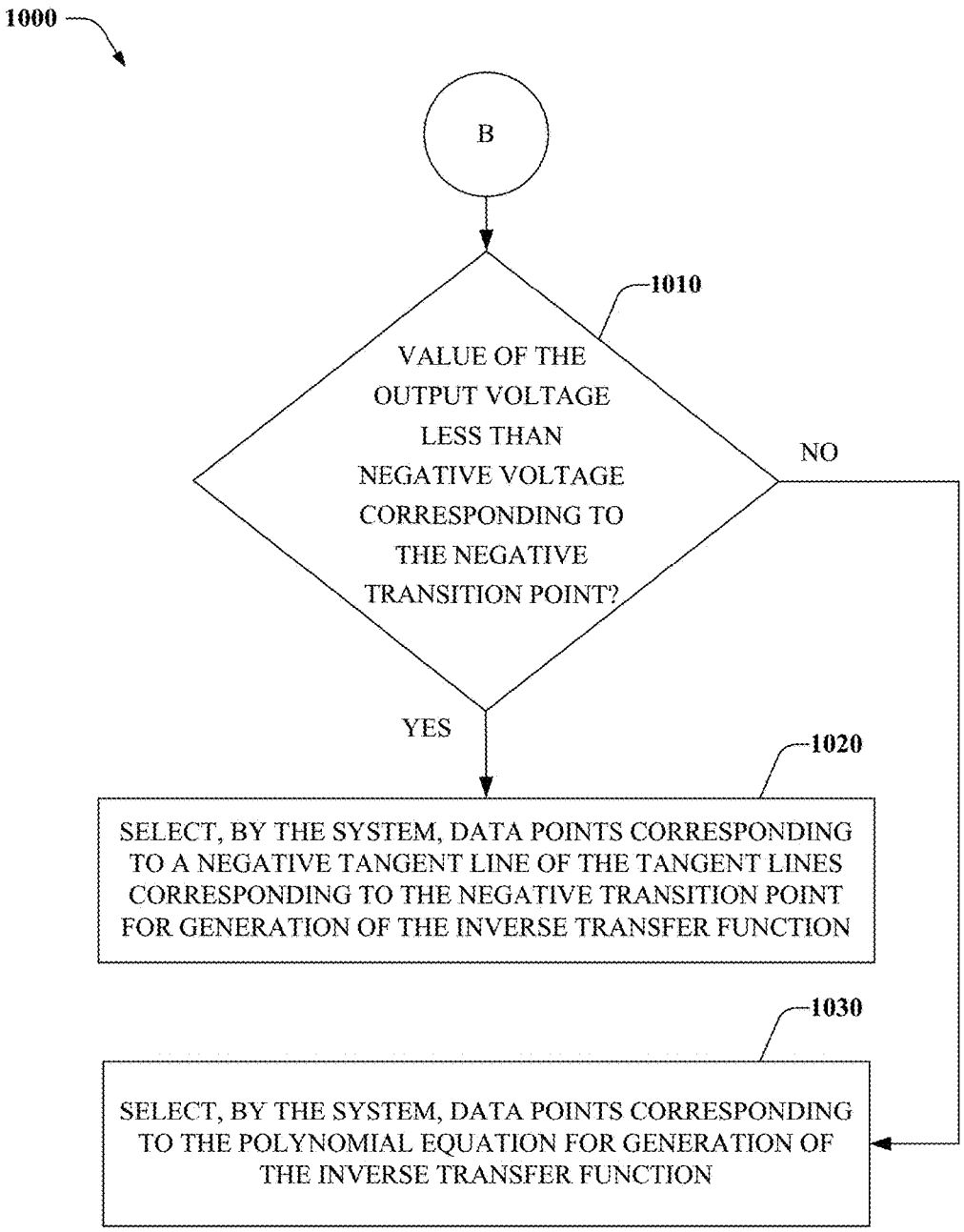

FIGS. 8-10 illustrate a methodology associated with a microphone system, e.g., 100, for selecting a "straight-line" function for respective portions of the polynomial equation to reduce algorithmically induced distortion, in accordance with various non-limiting aspects of the disclosed subject matter. At 810, the microphone system can determine a derivative of a polynomial equation representing a pressure-in to voltage-out transfer function representing a distortion of an output voltage of a microphone corresponding to an input stimulus of a defined SPL.

At 820, the microphone system can determine tangent lines corresponding to a positive transition point of the polynomial equation and a negative transition point of the polynomial equation. At 830, in response to an absolute value of the output voltage being determined to be less than or equal to a positive voltage corresponding to the positive transition point, and in response to the derivative of the polynomial equation being determined to be positive, flow continues to 840, at which the microphone system can select data points corresponding to the polynomial equation for generation of an inverse transfer function; otherwise, flow continues from 830 to 910.

At 910, in response to a value of the output voltage being determined to be greater than the positive voltage corresponding to the positive transition point, the microphone system can select, at 920, data points corresponding to a positive tangent line of the tangent lines corresponding to the positive transition point for generation of the inverse transfer function; otherwise, flow continues from 910 to 1010.

At 1010, in response to the value of the output voltage being determined to be less than a negative voltage corresponding to the negative transition point, the microphone system can select, at 1020, data points corresponding to a negative tangent line of the tangent lines corresponding to the negative transition point for generation of the inverse transfer function; otherwise flow continues from 1010 to 1030, at which the system can select data points corresponding to the polynomial equation for generation of the inverse transfer function.

As it employed in the subject specification, the terms "processor", "processing component", etc. can refer to substantially any computing processing unit or device, e.g., signal processing component 120, processing component 520, etc. comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, an analog circuit, or any combination thereof designed to perform the functions and/or processes described herein. Further, a processor can exploit nano-scale architectures such as, but not limited to, molecular and quantum-dot based transistors, switches and gates, e.g., in order to optimize space usage or enhance performance of mobile devices. A processor can also be implemented as a combination of computing processing units, devices, etc.

In the subject specification, terms such as "memory" and substantially any other information storage component relevant to operation and functionality of signal processing component 120, processing component 520, and/or devices disclosed herein, e.g., memory 540, etc. refer to "memory components," or entities embodied in a "memory," or components comprising the memory. It will be appreciated that the memory can include volatile memory and/or nonvolatile memory. By way of illustration, and not limitation, volatile memory, can include random access memory (RAM), which can act as external cache memory. By way of illustration and not limitation, RAM can include synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and/or Rambus dynamic RAM (RDRAM). In other embodiment(s) nonvolatile memory can include read only memory (ROM), programmable ROM (PROM), electrically programmable ROM (EPROM), electrically erasable ROM (EEPROM), or flash memory. Additionally, the components and/or devices disclosed herein can comprise, without being limited to comprising, these and any other suitable types of memory.

Figure 11:
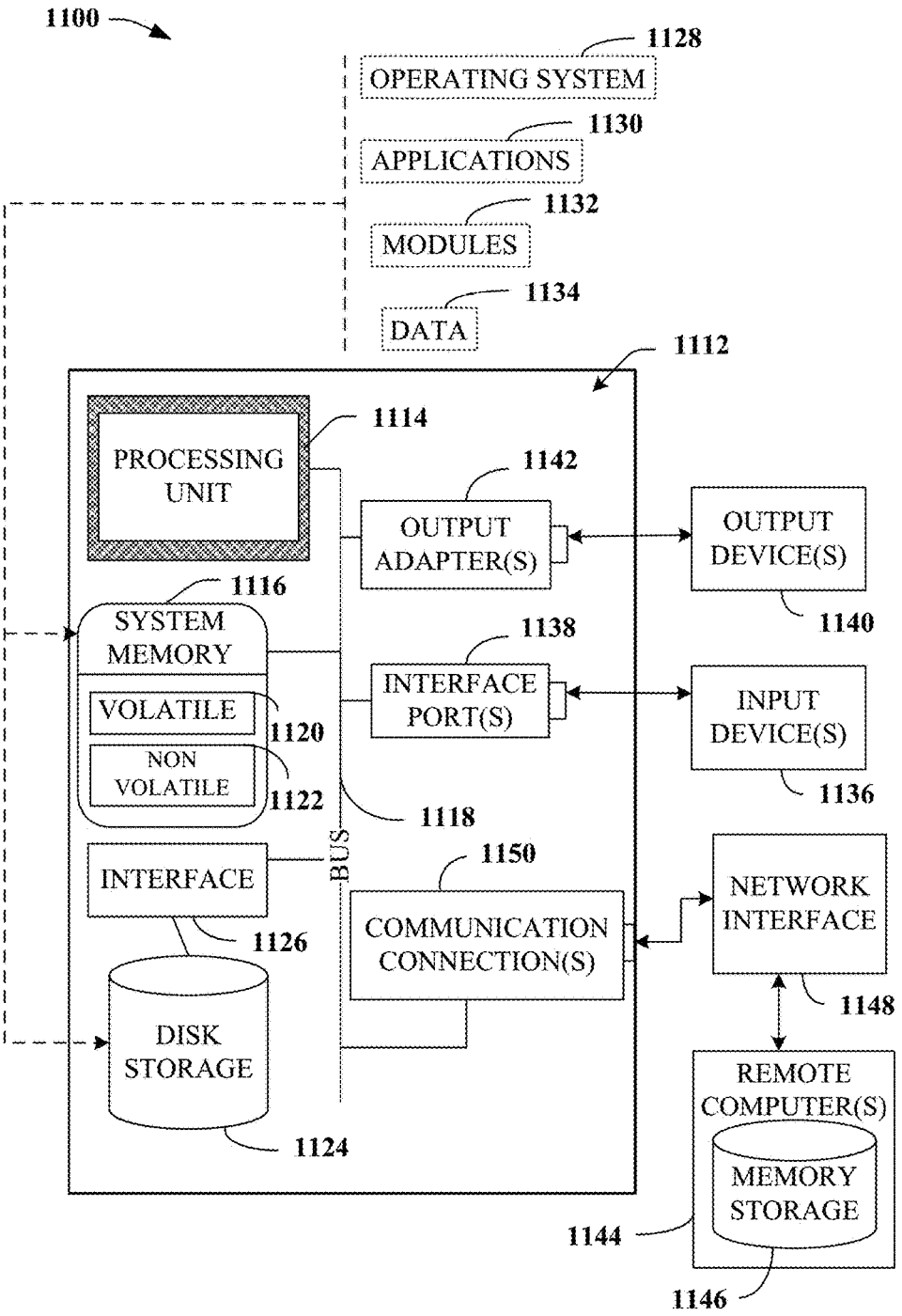
FIG. 11 illustrates a block diagram representing an illustrative non-limiting computing system or operating environment in which one or more aspects of various embodiments described herein can be implemented.

In order to provide a context for the various aspects of the disclosed subject matter, FIG. 11, and the following discussion, are intended to provide a brief, general description of a suitable environment in which the various aspects of the disclosed subject matter can be implemented, e.g., via microphone system 100. While the subject matter has been described above in the general context of computer-executable instructions of a computer program that runs on a computer and/or computers, those skilled in the art will recognize that the subject innovation also can be implemented in combination with other program modules. Generally, program modules include routines, programs, components, data structures, etc. that perform particular tasks and/or implement particular abstract data types.

Moreover, those skilled in the art will appreciate that the inventive systems can be practiced with other computer system configurations, including single-processor or multiprocessor computer systems, mini-computing devices, mainframe computers, as well as personal computers, handheld computing devices (e.g., PDA, phone, watch), microprocessor-based or programmable consumer or industrial electronics, and the like. The illustrated aspects can also be practiced in distributed computing environments where tasks are performed by remote processing devices that are linked through a communications network; however, some if not all aspects of the subject disclosure can be practiced on stand-alone computers. In a distributed computing environment, program modules can be located in both local and remote memory storage devices.

With reference to FIG. 11, a block diagram of a computing system 1100 operable to execute the disclosed components, systems, devices, methods, processes, etc., e.g., corresponding to microphone system 100, is illustrated, in accordance with an embodiment. Computer 1112 includes a processing unit 1114, a system memory 1116, and a system bus 1118. System bus 1118 couples system components including, but not limited to, system memory 1116 to processing unit 1114. Processing unit 1114 can be any of various available processors. Dual microprocessors and other multiprocessor architectures also can be employed as processing unit 1114.

System bus 1118 can be any of several types of bus structure(s) including a memory bus or a memory controller, a peripheral bus or an external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), Small Computer Systems Interface (SCSI), and/or controller area network (CAN) bus used in vehicles.

System memory 1116 includes volatile memory 1120 and nonvolatile memory 1122. A basic input/output system (BIOS), containing routines to transfer information between elements within computer 1112, such as during start-up, can be stored in nonvolatile memory 1122. By way of illustration, and not limitation, nonvolatile memory 1122 can include ROM, PROM, EPROM, EEPROM, or flash memory. Volatile memory 1120 includes RAM, which acts as external cache memory. By way of illustration and not limitation, RAM is available in many forms such as SRAM, dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 1112 can also include removable/non-removable, volatile/nonvolatile computer storage media, networked attached storage (NAS), e.g., SAN storage, etc. FIG. 11 illustrates, for example, disk storage 1124. Disk storage 1124 includes, but is not limited to, devices like a magnetic disk drive, floppy disk drive, tape drive, Jaz drive, Zip drive, LS-110 drive, flash memory card, or memory stick. In addition, disk storage 1124 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1124 to system bus 1118, a removable or non-removable interface is typically used, such as interface 1126.

It is to be appreciated that FIG. 11 describes software that acts as an intermediary between users and computer resources described in suitable operating environment 1100. Such software includes an operating system 1128. Operating system 1128, which can be stored on disk storage 1124, acts to control and allocate resources of computer system 1112. System applications 1130 take advantage of the management of resources by operating system 1128 through program modules 1132 and program data 1134 stored either in system memory 1116 or on disk storage 1124. It is to be appreciated that the disclosed subject matter can be implemented with various operating systems or combinations of operating systems.

A user can enter commands or information into computer 1112 through input device(s) 1136. Input devices 1136 include, but are not limited to, a pointing device such as a mouse, trackball, stylus, touch pad, keyboard, microphone, joystick, game pad, satellite dish, scanner, TV tuner card, digital camera, digital video camera, web camera, cellular phone, user equipment, smartphone, and the like. These and other input devices connect to processing unit 1114 through system bus 1118 via interface port(s) 1138. Interface port(s) 1138 include, for example, a serial port, a parallel port, a game port, a universal serial bus (USB), a wireless based port, e.g., WiFi, Bluetooth®, etc. Output device(s) 1140 use some of the same type of ports as input device(s) 1136.

Thus, for example, a USB port can be used to provide input to computer 1112 and to output information from computer 1112 to an output device 1140. Output adapter 1142 is provided to illustrate that there are some output devices 1140, like display devices, light projection devices, monitors, speakers, and printers, among other output devices 1140, which use special adapters. Output adapters 1142 include, by way of illustration and not limitation, video and sound devices, cards, etc. that provide means of connection between output device 1140 and system bus 1118. It should be noted that other devices and/or systems of devices provide both input and output capabilities such as remote computer(s) 1144.

Computer 1112 can operate in a networked environment using logical connections to one or more remote computers, such as remote computer(s) 1144. Remote computer(s) 1144 can be a personal computer, a server, a router, a network PC, a workstation, a microprocessor based appliance, a peer device, or other common network node and the like, and typically includes many or all of the elements described relative to computer 1112.

For purposes of brevity, only a memory storage device 1146 is illustrated with remote computer(s) 1144. Remote computer(s) 1144 is logically connected to computer 1112 through a network interface 1148 and then physically and/or wirelessly connected via communication connection 1150. Network interface 1148 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1150 refer(s) to hardware/software employed to connect network interface 1148 to bus 1118. While communication connection 1150 is shown for illustrative clarity inside computer 1112, it can also be external to computer 1112. The hardware/software for connection to network interface 1148 can include, for example, internal and external technologies such as modems, including regular telephone grade modems, cable modems and DSL modems, wireless modems, ISDN adapters, and Ethernet cards.

The computer 1112 can operate in a networked environment using logical connections via wired and/or wireless communications to one or more remote computers, cellular based devices, user equipment, smartphones, or other computing devices, such as workstations, server computers, routers, personal computers, portable computers, microprocessor-based entertainment appliances, peer devices or other common network nodes, etc. The computer 1112 can connect to other devices/networks by way of antenna, port, network interface adaptor, wireless access point, modem, and/or the like.

The computer 1112 is operable to communicate with any wireless devices or entities operatively disposed in wireless communication, e.g., a printer, scanner, desktop and/or portable computer, portable data assistant, communications satellite, user equipment, cellular base device, smartphone, any piece of equipment or location associated with a wirelessly detectable tag (e.g., scanner, a kiosk, news stand, restroom), and telephone. This includes at least WiFi and Bluetooth® wireless technologies. Thus, the communication can be a predefined structure as with a conventional network or simply an ad hoc communication between at least two devices.

WiFi allows connection to the Internet from a desired location (e.g., a vehicle, couch at home, a bed in a hotel room, or a conference room at work, etc.) without wires. WiFi is a wireless technology similar to that used in a cell phone that enables such devices, e.g., mobile phones, computers, etc., to send and receive data indoors and out, anywhere within the range of a base station. WiFi networks use radio technologies called IEEE 802.11 (a, b, g, etc.) to provide secure, reliable, fast wireless connectivity. A WiFi network can be used to connect communication devices (e.g., mobile phones, computers, etc.) to each other, to the Internet, and to wired networks (which use IEEE 802.3 or Ethernet). WiFi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 10BaseT wired Ethernet networks used in many offices.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A system, comprising:

a processor; and a memory that stores executable instructions that, when executed by the processor, facilitate performance of operations, comprising:

obtaining a pressure-in to signal-out transfer function representing a distortion of an output signal of a microphone corresponding to an input stimulus of a defined sound pressure level (SPL) that has been applied to the microphone;

creating an ideal sine wave stimulus based on an amplitude of a time domain waveform representing the output signal and a fundamental frequency of the time domain waveform;

generating, based on a defined relationship between the ideal sine wave stimulus and the time domain waveform, an equation representing the pressure-in to signal-out transfer function representing the distortion of the output signal; and inverting the equation to obtain an inverse transfer function for facilitating an application, by the microphone, of the inverse transfer function to the output signal to obtain a linearized output representing the input stimulus.

2. The system of claim 1, wherein the output signal is an output voltage, and wherein the obtaining comprises:

measuring the output voltage.

3. The system of claim 1, wherein the obtaining comprises:

deriving, during a simulation of a defined model of the microphone comprising production based parameters of the microphone, the output signal.

4. The system of claim 1, wherein the obtaining comprises:

importing output data of the time domain waveform representing the output signal; and based on the output data, obtaining properties of the time domain waveform comprising the amplitude of the time domain waveform and the fundamental frequency of the time domain waveform.

5. The system of claim 1, wherein the defined relationship represents a voltage difference between the ideal sine wave stimulus and the time domain waveform with respect to a defined alignment of respective phases of the ideal sine wave stimulus and the time domain waveform.

6. The system of claim 1, wherein the microphone comprises a micro-electro-mechanical system (MEMS) microphone.

7. The system of claim 6, wherein the MEMS microphone comprises:

a diaphragm that converts the SPL into an electrical signal;

a single backplate capacitively coupled to a side of the diaphragm; and an electronic amplifier that buffers the electrical signal to generate the output signal.

8. The system of claim 6, wherein the MEMS microphone comprises:

a diaphragm that converts the SPL into an electrical signal;

dual backplates capacitively coupled to respective sides of the diaphragm; and an electronic amplifier that buffers the electrical signal to generate the output signal.

9. The system of claim 1, wherein the distortion comprises odd-order harmonic distortion and even-order harmonic distortion.

10. The system of claim 9, wherein the distortion is not frequency dependent, and wherein the distortion is not time dependent.

11. A micro-electro-mechanical system (MEMS) microphone, comprising:

a processor; and a memory that stores executable instructions that, when executed by the processor, facilitate performance of operations, comprising:

creating an ideal sine wave stimulus representing an output signal of the MEMS microphone with respect to an input stimulus of a defined sound pressure level (SPL) that has been applied to the MEMS microphone, wherein the ideal sine wave stimulus is based on an amplitude of a time domain waveform representing the output signal and a fundamental frequency of the time domain waveform;

deriving, based on a defined relationship between the ideal sine wave stimulus and the time domain waveform, an equation of a transfer function representing a distortion of the output signal; and applying, based on the equation, a linearization filter to the output signal to obtain a linearized output representing the input stimulus.

12. The MEMS microphone of claim 11, wherein the output signal is an output voltage, and wherein the deriving the equation comprises:

obtaining output data of the time domain waveform representing the output voltage; and based on the output data, deriving properties of the time domain waveform comprising the amplitude of the time domain waveform and the fundamental frequency of the time domain waveform.

13. The MEMS microphone of claim 11, further comprising:

a diaphragm that converts the SPL into an electrical signal;

a single backplate capacitively coupled to a side of the diaphragm; and an electronic amplifier that buffers the electrical signal to generate the output signal.

14. The MEMS microphone of claim 11, further comprising:

a diaphragm that converts the SPL into an electrical signal;

dual backplates capacitively coupled to respective sides of the diaphragm; and an electronic amplifier that buffers the electrical signal to generate the output signal.

15. The MEMS microphone of claim 11, wherein the defined relationship represents a voltage difference between the ideal sine wave stimulus and the time domain waveform with respect to a defined alignment of respective phases of the ideal sine wave stimulus and the time domain waveform.

16. A method, comprising:

generating, by a system comprising a processor, a sine wave stimulus representing an output signal of a microphone with respect to an input stimulus that has been applied to the microphone, wherein the sine wave stimulus is based on an amplitude of a time domain waveform representing the output signal and a fundamental frequency of the time domain waveform;

selecting, by the system based on a defined relationship between the sine wave stimulus and the time domain waveform, an equation of a transfer function representing a distortion of the output signal; and facilitating, by the system, an application, by the microphone, of an inversion of the equation to the output signal to obtain a linearized output representing the input stimulus.

17. The method of claim 16, wherein the generating the sine wave stimulus comprises:

obtaining data representing the output signal of the microphone; and generating the sine wave stimulus having the amplitude of the time domain waveform and the fundamental frequency of the time domain waveform.

18. The method of claim 16, wherein the output signal is a voltage output, and wherein the selecting comprises:

measuring, by the system, the voltage output.

19. The method of claim 16, wherein the output signal is a voltage output, and wherein the selecting comprises:

deriving, during a simulation of a defined model of the microphone based on defined production parameters corresponding to the microphone, the voltage output.

20. The method of claim 16, wherein the selecting comprises:

selecting the equation based on a voltage difference between the sine wave stimulus and the time domain waveform with respect to a defined alignment of respective phases of the sine wave stimulus and the time domain waveform.

* * * * *